US007922110B2

(12) United States Patent
Sawford et al.

(10) Patent No.: US 7,922,110 B2
(45) Date of Patent: Apr. 12, 2011

(54) SHREDDING MACHINE

(75) Inventors: Michael D. Sawford, Bucks (GB); Kaush Patel, Middlesex (GB); Paul A. Aries, West Midland (GB)

(73) Assignee: ACCO UK Limited, Aylesbury (GB)

( * ) Notice: Subject to any disclaimer, the term of this patent is extended or adjusted under 35 U.S.C. 154(b) by 351 days.

(21) Appl. No.: 12/147,528

(22) Filed: Jun. 27, 2008

(65) Prior Publication Data

US 2009/0001203 A1 Jan. 1, 2009

(30) Foreign Application Priority Data

Jun. 29, 2007 (GB) ..... 0712709.5

(51) Int. Cl.
*B02C 4/32* (2006.01)
*B02C 7/14* (2006.01)

(52) U.S. Cl. ..... 241/36; 241/100; 241/236

(58) Field of Classification Search ..... 241/36, 241/100, 236

See application file for complete search history.

(56) References Cited

U.S. PATENT DOCUMENTS

| | | | | |
|---|---|---|---|---|
| 3,711,034 | A * | 1/1973 | Ehinger | 241/100 |
| 5,244,270 | A * | 9/1993 | Parker | 312/270.2 |
| 5,662,280 | A * | 9/1997 | Nishio et al. | 241/30 |
| 6,116,528 | A | 9/2000 | Schwelling | |
| 6,572,036 | B2 * | 6/2003 | Glucksman et al. | 241/27 |
| 6,962,301 | B1 * | 11/2005 | Chang | 241/100 |
| 7,475,838 | B2 * | 1/2009 | Mori et al. | 241/36 |
| 2002/0017577 | A1 * | 2/2002 | Rajewski | 241/30 |
| 2002/0153438 | A1 * | 10/2002 | Glucksman et al. | 241/36 |
| 2006/0091247 | A1 * | 5/2006 | Matlin | 241/36 |
| 2007/0176031 | A1 * | 8/2007 | Suzuki et al. | 241/36 |
| 2009/0127361 | A1 * | 5/2009 | Kelly et al. | 241/27 |
| 2009/0218425 | A1 * | 9/2009 | Sued et al. | 241/36 |

FOREIGN PATENT DOCUMENTS

| | | |
|---|---|---|
| DE | 19618478 | 9/1997 |
| EP | 1738830 | 1/2007 |
| GB | 2070785 | 9/1981 |

OTHER PUBLICATIONS

United Kingdom Search Report for Application No. GB0712709.5 dated Oct. 18, 2007.

* cited by examiner

*Primary Examiner* — Bena Miller
(74) *Attorney, Agent, or Firm* — Michael Best & Friedrich LLP

(57) ABSTRACT

A shredding machine is disclosed for shredding sheet material such as paper documents. The machine comprises an electric cutting mechanism which is operable to shred the sheet material, and has a collection bin arranged below the cutting mechanism for collection of the resulting shreds. The collection bin is movable in a pivotal manner between a first position in which it permits operation of the cutting mechanism and collects the shreds, and a second position in which it stops operation of the cutting mechanism. The bin is configured to move from the first position to the second position in response to the weight of shreds collected in the bin and the force acting on the collected shreds by fresh shreds exiting the cutting mechanism exceeding a predetermined threshold value.

17 Claims, 3 Drawing Sheets

SHREDDING MACHINE

The present invention relates to a shredding machine, and more particularly relates to a shredding machine for shredding sheet material. Most preferably, the present invention relates to a shredding machine in the form of a paper-shredder suitable for home or office use.

Over recent years it has become customary to provide shredding machines in domestic homes or workplaces such as offices, in order to provide a convenient method of securely disposing of confidential documentation or other sensitive papers.

Conventional paper-shredders of the type mentioned above are provided with a paper feed-aperture, usually in the form of a feed-slot of elongate form, through which a plurality of paper sheets or the like can be fed towards a pair of rotating cutters which are located below the feed-slot and which serve to shred the paper sheets into a plurality of strips having a width of only a few millimetres. The resulting strips of paper fall downwardly and are collected in a basket or bin located below the cutters.

As will be appreciated, when using shredding machines of the general type mentioned above, it is necessary for a user periodically to empty the collecting bin as it becomes filled with paper shreds. If the paper bin is not regularly emptied in this manner, the volume of papers shreds in the bin becomes excessive, thereby preventing substantially unrestricted downward movement of the paper shreds during subsequent shredding operations. This can lead to paper jams.

It has therefore been proposed previously to provide shredding machines of this generally type where if an arrangement which operates to stop the electric motor powering the rotary cutters in the event that the collecting bin reaches a predetermined fill-level. One such prior proposed arrangement involves the use of optical sensors located just below the cutting mechanism, and at the top of the collecting bin. When the mass of paper shreds collected within the bin reaches the height effective to trigger the optical sensor, the cutting mechanism is stopped. At this point in time, the shredding machine cannot be used further until the collecting bin is either emptied, or a user opens the bin and presses the mass of paper shreds, which will be relatively loosely packed, down into the bin more firmly in order to deliberate more space above the shreds, whereupon the bin can be re-closed and shredding operations can continue.

As will be appreciated, the above-mentioned sensor arrangement does suffer from some disadvantages, for example, because the paper shreds collect in a relatively loose manner in the bin, they pile up relatively quickly within the bin, thereby triggering the optical sensor which necessitates frequent, and inconvenient, manual intervention on the part of the user by opening the bin and pressing the mass of shreds downwardly in order to deliberate more space.

It is therefore an object of the present invention to provide an improved shredding machine for shredding sheet material.

Accordingly, the present invention provides a shredding machine for shredding sheet material, the machine comprising an electric cutting mechanism operable to shred sheet material fed in to the machine, and a collection bin arranged for movement between a first position in which it permits operation of the cutting mechanism and collects shreds from the cutting mechanism, and a second position effective to stop operation of the cutting mechanism, wherein the bin is configured to move from the first position to the second position in response to a force acting on the shreds collected in the bin exceeding a predetermined threshold value.

Preferably, the weight of the shreds collected in the bin forms at least a component of said force.

Advantageously, pressure generated by shreds exiting the cutting mechanism and pushing against shreds collected in the bin forms at least a component of said force.

Conveniently, said force acts generally downwardly.

Advantageously, movement of the collection bin from the first position to the second position is effective to stop the cutting mechanism only after the passage of a predetermined period of time.

Preferably, the shredding machine comprises a catch effective to releasably engage the bin and retain it in its first position until said threshold value is exceeded, whereupon the catch releases the bin allowing the bin to move to its second position.

Advantageously, the catch is a magnetic catch.

Conveniently, the catch is a mechanical catch.

Preferably, the catch is configured to operate via friction.

Advantageously, the bin is located substantially below the cutting mechanism.

Conveniently, the bin is arranged for pivotal movement relative to the cutting mechanism.

Preferably, the first position of the bin is a substantially closed position in which access to the inside of the bin is prevented, and the second position is an at least partially-open position allowing access to the inside of the bin.

Advantageously, the bin is removable from the machine when in its second position.

Conveniently, removal of the bin from the machine is effective to disable the cutting mechanism, thereby preventing operation of the cutting mechanism in the absence of the bin.

Preferably, the shredding machine comprises a sensor configured to detect movement of the bin from its first position to its second position and to stop operation of the cutting mechanism in response to said movement.

Advantageously, the shredding machine comprises a sensor configured to detect removal of the bin from the machine and to disable the cutting mechanism in response to said removal.

Conveniently, the or each sensor is a micro-switch.

Preferably, the shredding machine takes the form of a paper-shredder suitable for home or office use.

So that the invention may be more readily understood, and so that further features thereof may be appreciated, an embodiment of the invention will now be described, by way of example, with reference to the accompanying drawings, in which.

Figure 1:
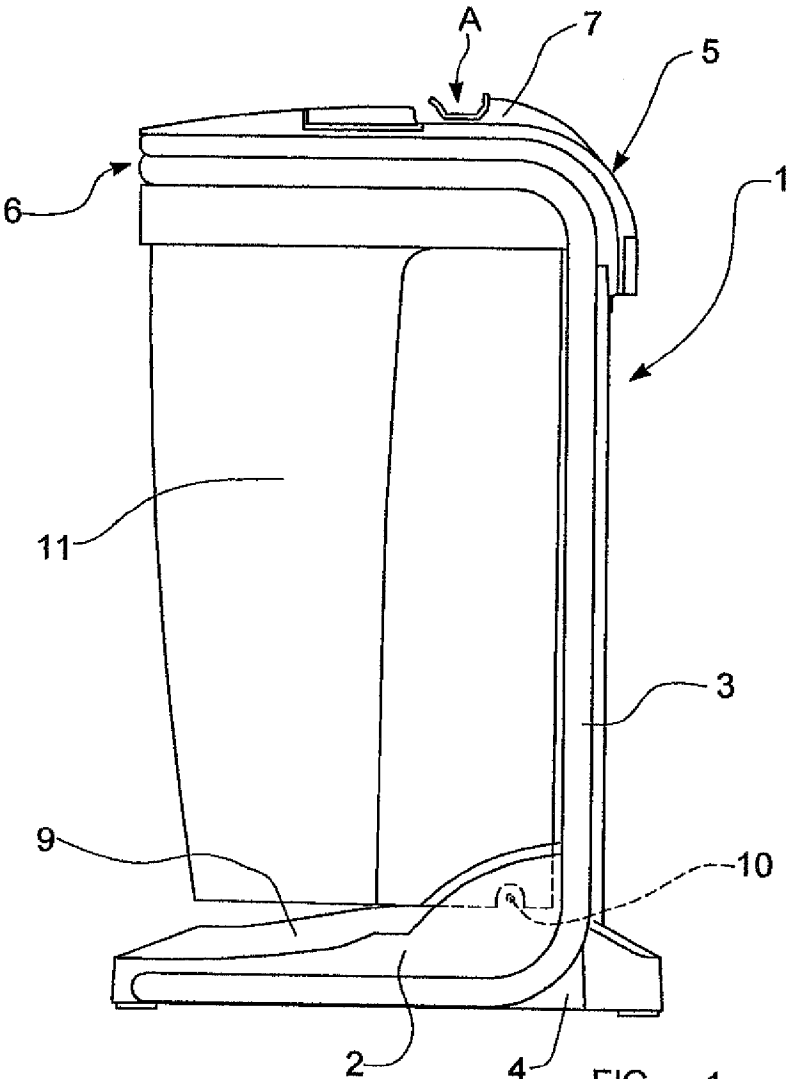
FIG. 1 is a side view illustrating a shredding machine in accordance with the present invention with its collection bin in a first position.

Referring initially to FIG. 1, a shredding machine 1 (referred to hereinafter simply as a shredder) is shown, viewed from the side, in a normal operative position. The shredder comprises a base 2, from the rear part of which extends a supporting frame 3 in a substantially vertical direction. The actual configuration of the frame 3 is not of particular importance to the operation of the present invention per se, but the frame 3 illustrated takes the form of a tubular frame formed from steel tubing. Plastic tubing could also be used to form the frame. As can be seen in FIG. 1, the tubing of the frame extends from a lower region of the base 2, on one side of the base, in a rearwards direction towards the rear part 4 of the base, at which point the tubing is bent upwardly so as to extend in a substantially vertical direction. In a region indicated generally at 5, the tubing is bent through approximately 90° so as to extend forwardly, generally parallel to the base 2, and is then bent through another 90° angle so as to extend generally horizontally across the front part 6 of the shredder 1 (in a direction generally into the page as illustrated in FIG. 1). The tubing then follows a similar curved path on the other side of the shredder so as to terminate on the opposite side of the base 2

Figure 5:
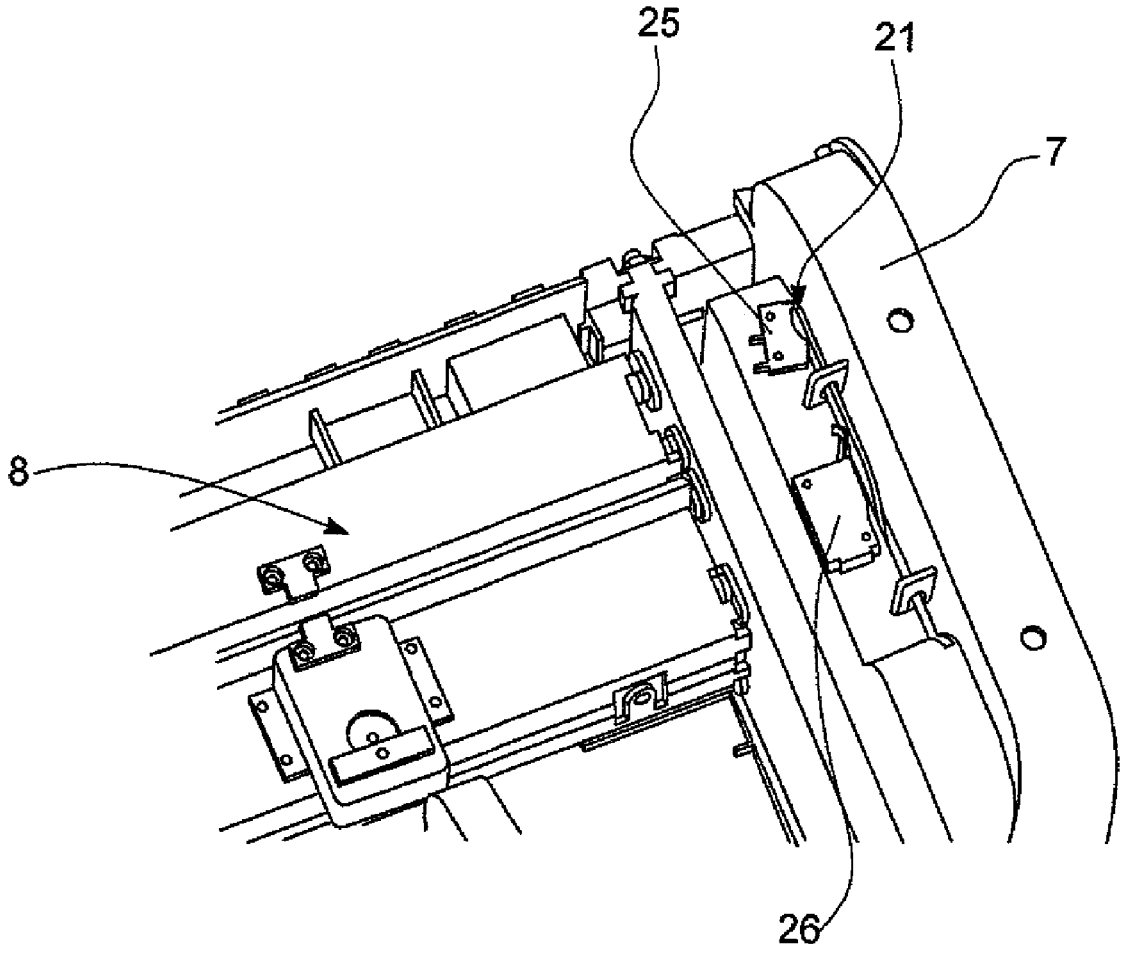
FIG. 5 is a perspective view from above illustrating part of the shredding machine housing the cutting mechanism.

The upper, generally horizontally extending region of the frame 3 supports a housing 7 within which is provided an electric cutting mechanism 8 (seen more clearly in FIG. 5). By virtue of the frame 3, it will be noted that the housing 7 is spaced generally vertically above the base 2.

Considering the base 2 in more detail, it should be appreciated that the base 2 has a generally ramped portion 9 which extends upwardly, towards the rear of the base 2. The result is that the front part of the base 2 is lower than the highest point of the rear part of the base 2. The raised rear part of the base 2 defines horizontal pivot axis 10 extending across the rear part of the shredder. In a preferred embodiment, the pivot axis 10 is defined by a horizontal bar extending between the two raised rear side portions of the base 2. The function of the pivot axis 10 will become clear in the following description.

As illustrated in FIG. 1, the shredder 1 is provided with a collection bin 11 which is illustrated in a first, operative, position in which it is received generally between the base 2 and the housing 7. The bin 11 defines a large interior chamber intended to collect shreds falling from the cutting mechanism within the housing 7 during operation of the shredder.

Figure 2:
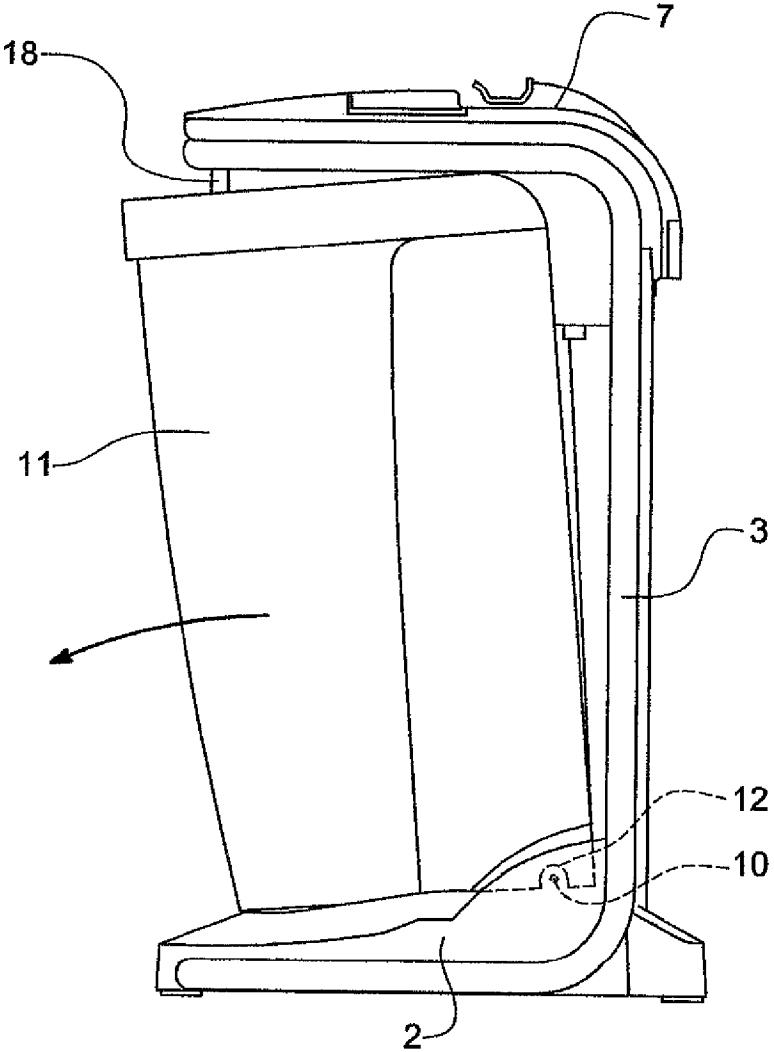
FIG. 2 is a view corresponding generally to that of FIG. 1, but illustrates the collection bin in a second, alternate position.

As illustrated more clearly in FIG. 2, the bin 11 is pivotally engaged with the base 2, about the pivot axis 10. More particularly, in a preferred embodiment, the rear part of the bin 11, at its lowermost end, is provided with a downwardly-open channel 12 of generally arcuate cross-section, which is configured to receive, and hence rest upon the bar defining the pivot axis 10 and which extends between the two raised rear parts of the base 2. This pivotal engagement between the bin 11 and the base 2 means that the bin is effectively arranged for pivotal movement between its first position illustrated in FIG. 1, in which the bin collects shreds from the cutting mechanism, and a second position, illustrated in FIG. 2, in which the bin is at least partially open, enabling (albeit limited) access to the internal chamber of the bin.

By virtue of the open nature of the channel 12, it should be appreciated that the bin 11 is also removable from the base 2 and so, when in it is in its second position illustrated in FIG. 2, the bin can quite easily be lifted off the base 2 and removed in order for its contents to be more conveniently emptied.

Figure 3:
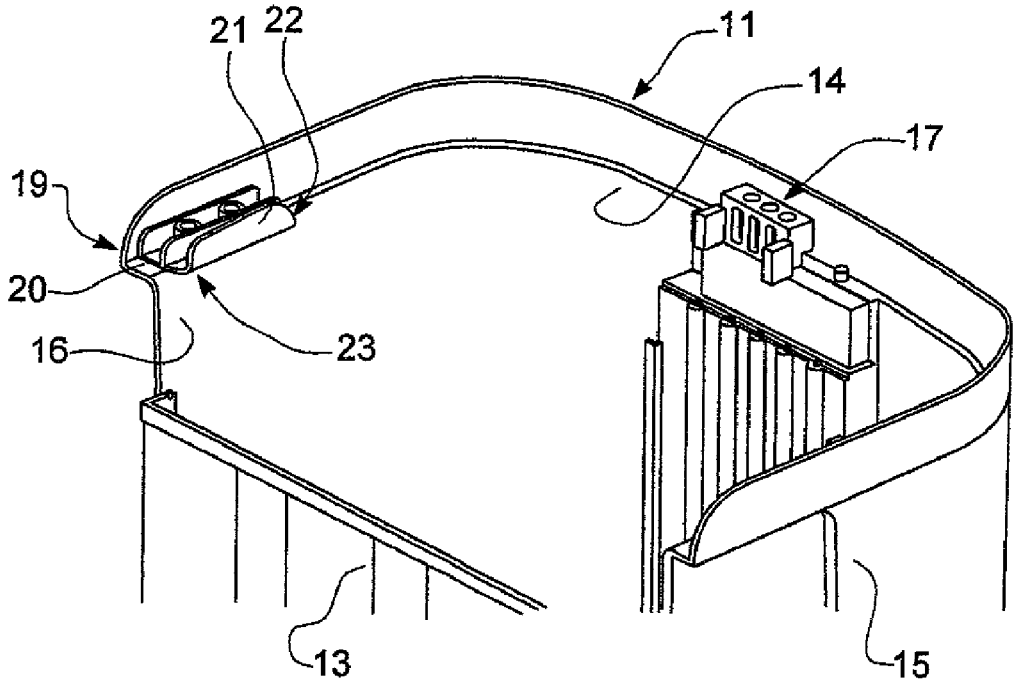
FIG. 3 is a perspective view from above, and the opposite side, illustrating the upper part of the collection bin, with other parts of the shredding machine omitted.

Turning now to consider FIG. 3, the upper region of the bin 11 is illustrated in more detail, viewed from above and the opposite side to that illustrated in FIGS. 1 and 2. As can be seen, the rear wall 13 of the bin 11 is slightly shorter in vertical height than the front wall 14 and the two side walls 15, 16. This means that the front wall 14, and the two side walls 15, 16 define an upwardly-extending skirt which, in operation, fits around the main part of the housing 7 which extends below the upper part of the frame 3, as illustrated most clearly in FIG. 2. The shorter rear wall 13 allows the main part of the housing 7, below the level of the upper part of the frame 3, to pass into the upper part of the bin 11 as the bin 11 is placed on the base 2, with the pivot bar 10 received within its downwardly-open channel 12.

A catch 17 is provided which, in the embodiment illustrated in the drawings, is provided at a generally central location across the top of the front wall 14 of the bin 11. The catch 17 is configured to provide a releasable connection between the bin 11 and the housing 7, via co-operation with a corresponding catch component 18 provided at the front of the housing 7.

The preferred embodiment of the present invention uses a magnetic catch 17 which is configured to retain the bin 11 in its first position illustrated in FIG. 1, against forces tending to move the bin towards its second position illustrated in FIG. 2, until such time as those forces exceed the magnetic force of attraction holding the catch closed, whereupon the catch is released, and the bin 11 is allowed to move to its second position illustrated in FIG. 2. The manner, and intended purpose of this release will be described in more detail below. However, it should be appreciated at this point that in alternative embodiments, the magnetic catch 17 could be replaced with a mechanical catch, or perhaps even a frictional catch, each of which is configured to hold the bin closed until such point as forces tending to move the bin towards its second position illustrated in FIG. 2 reach a predetermined level, and overcome the closing force of the catch.

Referring again to FIG. 3, the side wall 16 is provided with a bracket 19 which extends inwardly of the bin from an upper edge region of the side wall 16. As can be seen, the bracket is fixedly mounted on a small horizontal shoulder 20, at the rear part of the bin 11. The bracket 19 defines, along its innermost edge, an upwardly-directed blade element 21 which is slightly tapered so as to have a larger vertical extent at its forwardmost end 22 than its rearmost end 23.

Figure 4:
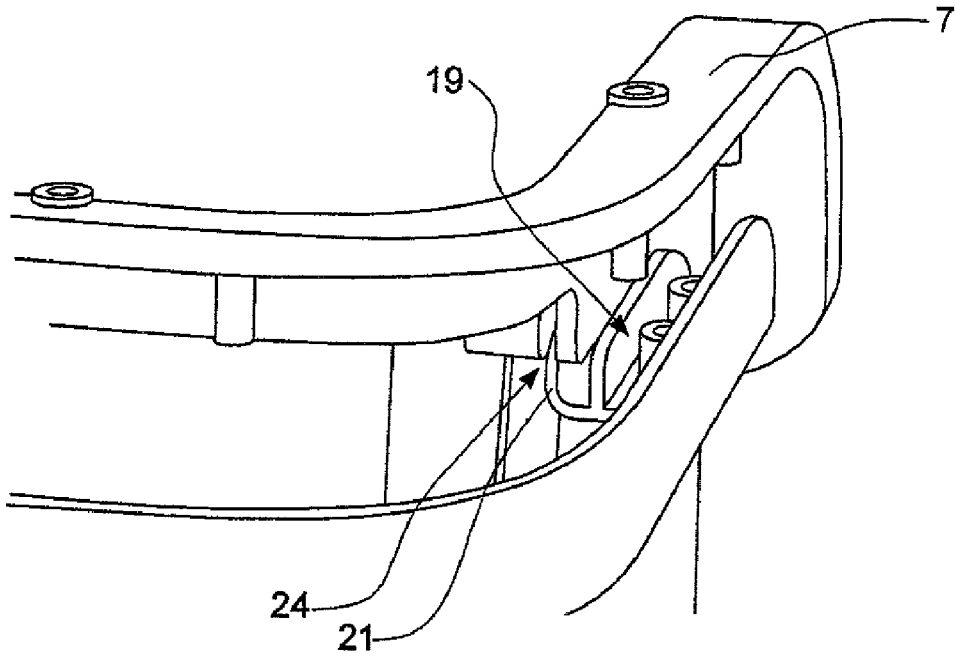
FIG. 4 is a perspective view from the front and one side, illustrating an upper part of the collection bin and its co-operation with another part of the structure of the shredding machine.

FIG. 4 illustrates, in closer detail, co-operation of the bracket 19 with a downwardly-open slot 24 provided in a corresponding side part of the housing 7. As can be seen, the blade element 21 is slidably received within the slot 24 when the bin 11 is mounted on the pivotal axis 10 of the base 2, and is free for sliding movement within the slot 24 as the bin moves from its first position illustrated in FIG. 1, to its second position illustrated in FIG. 2.

FIG. 5 illustrates the configuration of the housing 7 when viewed from above and, in particular, shows the blade element 21 extending through the slot 24, when the bin 11 is in its first, substantially closed, position illustrated in FIG. 1.

At the rear part of the slot 24, there is provided a first sensor 25 which, in the preferred embodiment illustrated, takes the form of a micro-switch, the operative part of which extends at least partially across the slot 24 so as to be actuated by the rear part of the blade element 21. In the position of the blade element 21 illustrated in FIG. 5, which is representative of the bin 11 being in its fully-closed position illustrated in FIG. 1, the blade element 21 closes the micro-switch 25. The micro-switch 25 is provided in electrical connection with the cutting mechanism 8 in such a manner as to allow energisation of the cutting motor when the switch is closed in this manner.

When the bin 11 is moved from its first position illustrated in FIG. 1 to its second, open position illustrated in FIG. 2, the upper rear part of the bin effectively moves forwards relative to the housing 7, this movement being effective to move the rear part of the blade element 21 out of engagement with the micro-switch sensor 25, thereby opening the micro-switch 25 which is thus effective to break the electrical circuit providing power to the cutting motor. It should therefore be appreciated that movement of the bin 11, from the position illustrated in FIG. 1, to the position illustrated in FIG. 2, is effective to stop operation of the cutting mechanism, if the cutting mechanism is in operation as this movement occurs.

In the preferred embodiment, the micro-switch forms part of a clock circuit and, when opened, is effective to trigger the clock circuit which, in turn, is arranged to break the electrical circuit providing power to the cutting motor only after a predetermined time period; typically a few seconds. Thus, when the bin is moved to its second, open position, the cutting mechanism is allowed to continue running for a few seconds, which helps to ensure that the cutters are clear of paper by the time the mechanism stops.

As also illustrated in FIG. 5, a second sensor 26 is provided, towards the front of the slot 24 and is arranged to co-operate with the blade element 21 carried by the bin in a substantially identical manner to the first sensor 25. Indeed, in the preferred embodiment, the second sensor 26 also takes the form of a micro-switch, having its operative part extending at least partially across the slot 24 so as to be actuated by movement of the blade element 21 within the slot 24.

The second sensor 26 is also electrically connected to the electric cutting mechanism of the shredder and serves to cut power to the cutting mechanism when it is not actuated by the blade element 21. However, due to the positioning of the sensor 26, and the configuration of the blade element 21, it should be appreciated that the blade element 21 actuates the sensor 26 both in the first position of the bin 11 illustrated in FIG. 1, and the second position of the bin 11 illustrated in FIG. 2. Even in the open position of FIG. 2, the blade element 21 extends sufficiently into the slot 24 to close the micro-switch of the second sensor 26. However, should the bin 11 be removed from the shredder, as mentioned above, then clearly the blade element 21 will be completely removed from the slot 24 thus allowing the micro-switch 26 to open, thereby cutting power to the electric cutting mechanism. This serves as a safety interlock feature, to prevent operation of the cutting mechanism in the absence of the bin 11, regardless of the actuation state of the first sensor 25.

Operation of the shredder described above will now be described, beginning with the consideration of FIG. 1.

FIG. 1 shows the bin 11 in its normally-closed, operative position in which it extends around the housing 7 and such that the blade element 21 is effective to close both micro-switches 25, 26. In this condition, sheet material for shredding, such as paper, is inserted into the feed slot of the shredder as indicated generally by arrow A. Typically, insertion of the paper into the feed slot is effective automatically to activate the electric cutting mechanism which is effective to shred the paper as it is drawn into the shredder. The resulting shreds, which typically take the form of elongate paper strips, fall into the collection bin 11 and are hence collected within the bin.

Normal operation of the shredder continues, as described above, as more and more sheets are shredded, such that the volume of shreds collected in the bin increases. The shreds build up into a generally pyramid-shaped pile within the bin 11, the pile increasing in weight and size until, as the bin becomes nearly full, the paper exiting the cutting mechanism applies generally downwards pressure to the mass of collected shreds as it presses against the growing mass of shreds in the bin. This continues until such time as the generally downwards force acting on the shreds, having a component attributable to the weight of the shreds and a component attributable to the pressure exerted on the mass of shreds by paper exiting the cutting mechanism, exceeds a predetermined threshold value as determined by the force necessary to release the catch 17. When this occurs, the bin 11 is free to move pivotally, about the pivot axis 10 so as to move from the first position illustrated in FIG. 1 to the second position illustrated in FIG. 2. As will be appreciated, when this movement occurs, the blade element 21 moves out of engagement with the first micro-switch 25 which is thus effective to stop the cutting mechanism, after the predetermined time defined by the clock circuit, if the cutting mechanism is in operation at the time at which the catch 17 becomes released. In this manner, operation of the shredding machine is stopped when the bin 11 reaches a predetermined fill-level (as defined by the weight of paper shreds within the bin rather than by their volume per se). The movement of the bin to the second position illustrated in FIG. 2 also provides a convenient visual indication to a user of the shredding machine that the bin is sufficiently full as to require emptying.

It should therefore be appreciated that, without any optical sensors provided across the top of the bin 11, the bin 11 is allowed to fill more densely with paper shreds than in conventional shredders, and will only be stopped from further operation when the weight of collected shreds exceeds a predetermined threshold value, rather than simply when their volume becomes such as to actuate a sensing system. This has been found to obviate the rather frequent need to open the collection bins of conventional shredders and press the collected shreds down more densely in order to allow the remaining volume of the bin to be used during subsequent shredding operations.

As indicated above, when the bin 11 moves to its second, dropped-down position illustrated in FIG. 2, it can then conveniently be completely removed from the shredder, by disengagement with the pivot axis 10 for emptying. Removal of the bin 11 causes the second micro-switch 26 to open, in the manner described above, which is effective to disable the cutting mechanism in response to removal of the bin. This prevents inadvertent operation of the cutting mechanism in the absence of the bin, for example by the insertion of papers into the feed slot of the shredder when the bin is removed, and hence serves as a safety feature in order only to allow operation of the cutting mechanism.

When the bin 11 has been emptied in this manner, it is then re-inserted into the shredder and closed, so as to adopt, once more, the position illustrated in FIG. 1, whereupon shredding operations can continue.

Whilst the present invention has been described in detail with reference to a preferred embodiment, it should be appreciated that modifications or alterations could be made without departing from the scope of the claimed invention. For example, whilst the preferred embodiment described above operates on the basis of pivotal movement of the collection bin, variants of the invention could alternatively use substantially translational, sliding, movement, either in a vertical or a horizontal sense.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A shredding machine for shredding sheet material, the machine comprising an electric cutting mechanism operable to shred sheet material fed in to the machine, and a collection bin arranged for movement between a first position in which it permits operation of the cutting mechanism and collects shreds from the cutting mechanism, and a second position effective to stop operation of the cutting mechanism, wherein the bin is configured to move from the first position to the second position in response to a force acting on the shreds collected in the bin exceeding a predetermined threshold value, and wherein movement of the collection bin from the first position to the second position is effective to stop the cutting mechanism only after the passage of a predetermined period of time.

2. A shredding machine according to claim 1, wherein the weight of the shreds collected in the bin forms at least a component of said force.

3. A shredding machine according to claim 1, wherein pressure generated by shreds exiting the cutting mechanism and pushing against shreds collected in the bin forms at least a component of said force.

4. A shredding machine according to claim 1, wherein said force acts generally downwardly.

5. A shredding machine according to claim 1 further comprising a catch effective to releasably engage the bin and retain it in its first position until said threshold value is exceeded, whereupon the catch releases the bin allowing the bin to move to its second position.

6. A shredding machine according to claim 5, wherein the catch is a magnetic catch.

7. A shredding machine according to claim 5, wherein the catch is a mechanical catch.

8. A shredding machine according to claim 5, wherein the catch is configured to operate via friction.

9. A shredding machine according to claim 1, wherein the bin is located substantially below the cutting mechanism.

10. A shredding machine according to claim 1, wherein the bin is arranged for pivotal movement relative to the cutting mechanism.

11. A shredding machine according to claim 1, wherein the first position of the bin is a substantially closed position in which access to the inside of the bin is prevented, and the second position is an at least partially-open position allowing access to the inside of the bin.

12. A shredding machine according to claim 1, wherein the bin is removable from the machine when in its second position.

13. A shredding machine according to claim 12, wherein removal of the bin from the machine is effective to disable the cutting mechanism, thereby preventing operation of the cutting mechanism in the absence of the bin.

14. A shredding machine according to claim 1, comprising a sensor configured to detect movement of the bin from its first position to its second position and to stop operation of the cutting mechanism in response to said movement.

15. A shredding machine according to claim 1, comprising a sensor configured to detect removal of the bin from the machine and to disable the cutting mechanism in response to said removal.

16. A shredding machine according to claim 14, wherein the sensor is a micro-switch.

17. A shredding machine according to claim 1 in the form of a paper-shredder suitable for home or office use.

* * * * *